US011530886B2

(12) United States Patent
Bray

(10) Patent No.: US 11,530,886 B2
(45) Date of Patent: Dec. 20, 2022

(54) BOLT CATCH FOR FIREARM

(71) Applicant: Polaris Capital LLC, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 17/154,882

(22) Filed: Jan. 21, 2021

(65) Prior Publication Data

US 2021/0222971 A1 Jul. 22, 2021

Related U.S. Application Data

(60) Provisional application No. 62/964,085, filed on Jan. 21, 2020.

(51) Int. Cl.

| | |
|---|---|
| ***F41A 3/68*** | (2006.01) |
| ***F41A 9/59*** | (2006.01) |
| ***F41A 3/66*** | (2006.01) |
| ***F41A 17/36*** | (2006.01) |
| *F41A 35/06* | (2006.01) |

(52) U.S. Cl.

CPC ..... *F41A 3/68* (2013.01); *F41A 3/66* (2013.01); *F41A 17/36* (2013.01); *F41A 9/59* (2013.01); *F41A 35/06* (2013.01)

(58) Field of Classification Search

CPC .... F41A 3/68; F41A 35/06; F41A 3/66; F41A 17/38

USPC ..... 89/138; 42/6

See application file for complete search history.

(56) References Cited

U.S. PATENT DOCUMENTS

| | | | | |
|---|---|---|---|---|
| 6,851,346 | B1 | 2/2005 | Herring | |
| 7,661,219 | B1 | 2/2010 | Knight, Jr. et al. | |
| 8,261,652 | B2 | 9/2012 | Findlay | |
| 8,327,749 | B2 | 12/2012 | Underwood | |
| 8,359,966 | B1 | 1/2013 | Brotherton | |
| 8,695,477 | B2 * | 4/2014 | Esch | F41A 17/42 89/138 |
| 9,291,412 | B1 * | 3/2016 | Montes | F41A 17/36 |
| D779,015 | S | 2/2017 | Underwood | |
| 9,651,328 | B1 | 5/2017 | Oglesby | |
| 2010/0251591 | A1 | 10/2010 | Burt et al. | |

(Continued)

OTHER PUBLICATIONS

PCT, "Notification of transmittal of the international search report and the written opinion of the international searching authority, or the declaration", ISA, dated Nov. 4, 2021, pp. 1-15.

(Continued)

*Primary Examiner* — Reginald S Tillman, Jr.
(74) *Attorney, Agent, or Firm* — Kunzler Bean & Adamson

(57) ABSTRACT

An apparatus for ambidextrous control of a bolt carrier and/or a magazine release is disclosed. In certain examples, the apparatus includes a lower receiver of a firearm including a protrusion extending outward from a first side of the lower receiver, the protrusion. The protrusion, in certain examples, includes a first slot for receiving an L-shaped lever, the L-shaped lever having a vertical arm coupled to a bolt catch lever and a horizontal arm that extends through a trigger area to a second side of the lower receiver that is opposite the first side. In certain examples, the protrusion also includes a second slot for receiving a magazine catch lever.

19 Claims, 7 Drawing Sheets

(56) References Cited

U.S. PATENT DOCUMENTS

| | | | | |
|---|---|---|---|---|
| 2010/0275485 | A1 | 11/2010 | Findlay | |
| 2012/0167424 | A1 | 7/2012 | Gomez | |
| 2014/0053444 | A1* | 2/2014 | Garrett | F41A 35/06 42/6 |
| 2016/0069628 | A1* | 3/2016 | Fluhr | F41A 35/06 42/6 |
| 2016/0116242 | A1 | 4/2016 | McGinty | |
| 2016/0258696 | A1 | 9/2016 | Fluhr et al. | |
| 2017/0241729 | A1* | 8/2017 | Gangl | F41A 17/36 |
| 2021/0222971 | A1 | 7/2021 | Bray | |

OTHER PUBLICATIONS

CMT Tactical. "UHP15A AMBI Billet Lower Receiver", [online]. Oct. 8, 2018; [Retrieved on Sep. 14, 2021]. Retrieved from the internet <url: https://web.archive.org/web/20181008192308/https://www.cmttac.com/ar15%20ambi%20lower-ambi%20lower>; figure 4.

* cited by examiner

BOLT CATCH FOR FIREARM

CROSS-REFERENCES TO RELATED APPLICATIONS

This application claims the benefit of, and claims priority to, U.S. Provisional Patent Application No. 62/964,085 entitled "IMPROVED BOLT CATCH FOR FIREARM" and filed on Jan. 21, 2020 for Ernest R. Bray, et. al, which is incorporated herein by reference.

FIELD

This disclosure relates generally to firearms, and more particularly relates to bolt carrier catches that lock or unlock the bolt carrier.

BACKGROUND

A bolt carrier group in M16-style rifles (often referred to simply as "bolt carrier") is the mechanism that facilitates the loading/firing/unloading of ammunition. With regards to the M16 family of firearms, the charging handle is used to manually adjust the position of the bolt carrier, which is useful to load ammunition, clear malfunctions, and retract the bolt carrier for cleaning and inspection. A bolt carrier catch is used to aid in the adjustment of a firearm and place the bolt carrier in and out of "battery," or in other words, to make the firearm ready to fire.

Battery assist devices are usually attachments to a bolt catch to make the firearm more user friendly, by allowing the operation of the bolt catch from either side of the firearm. Often an L-shaped lever is attached to the bolt catch that extends through the trigger area to the right side of the rifle. However, these L-shaped levers, which attach to the top paddle of the bolt catch, overload the bolt catch spring and make the bolt catch finicky and subject to accidental activations. Also, a round of ammunition may accidentally activate the bolt catch. The L-shaped levers are also exposed and subject to snagging and breaking.

SUMMARY

An apparatus for ambidextrous control of a bolt carrier and/or a magazine release is disclosed. In certain examples, the apparatus includes a lower receiver of a firearm including a protrusion extending outward from a first side of the lower receiver, the protrusion. The protrusion, in certain examples, includes a first slot for receiving an L-shaped lever, the L-shaped lever having a vertical arm coupled to a bolt catch lever and a horizontal arm that extends through a trigger area to a second side of the lower receiver that is opposite the first side. In certain examples, the protrusion also includes a second slot for receiving a magazine catch lever.

In certain examples, the protrusion also includes an opening for receiving a fastener that passes through at least one of the L-shaped lever or the magazine catch lever. The fastener may pass through both of the levers. In certain examples, the lower receiver includes a slot formed in the trigger area configured to receive the L-shaped lever. The slot may extend laterally from the first side to the second side.

In certain examples, the vertical arm is pivotally coupled to the bolt catch lever, and the bolt catch lever also includes a rearwardly extending region configured to engage an end of the L-shaped lever. In certain examples, the magazine catch lever is an elongated member having a first end for engaging a magazine catch shaft and a second end forming a finger pad. The magazine catch shaft extends from a first end to a second end, where threads are disposed adjacent the first end, and where a coupling mechanism is disposed adjacent the second end and configured to engage the first end of the magazine catch lever.

In certain examples, a magazine release button is configured to couple to the first end of the magazine catch shaft. Also included, in certain examples, is a magazine catch bar coupled at the second end of the magazine catch shaft, and configured to secure a magazine in a magazine well of the lower receiver.

BRIEF DESCRIPTION OF THE DRAWINGS

In order that the advantages of the invention will be readily understood, a more particular description of the invention briefly described above will be rendered by reference to specific examples that are illustrated in the appended drawings. Understanding that these drawings depict only typical examples of the invention and are not therefore to be considered to be limiting of its scope, the invention will be described and explained with additional specificity and detail through the use of the accompanying drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
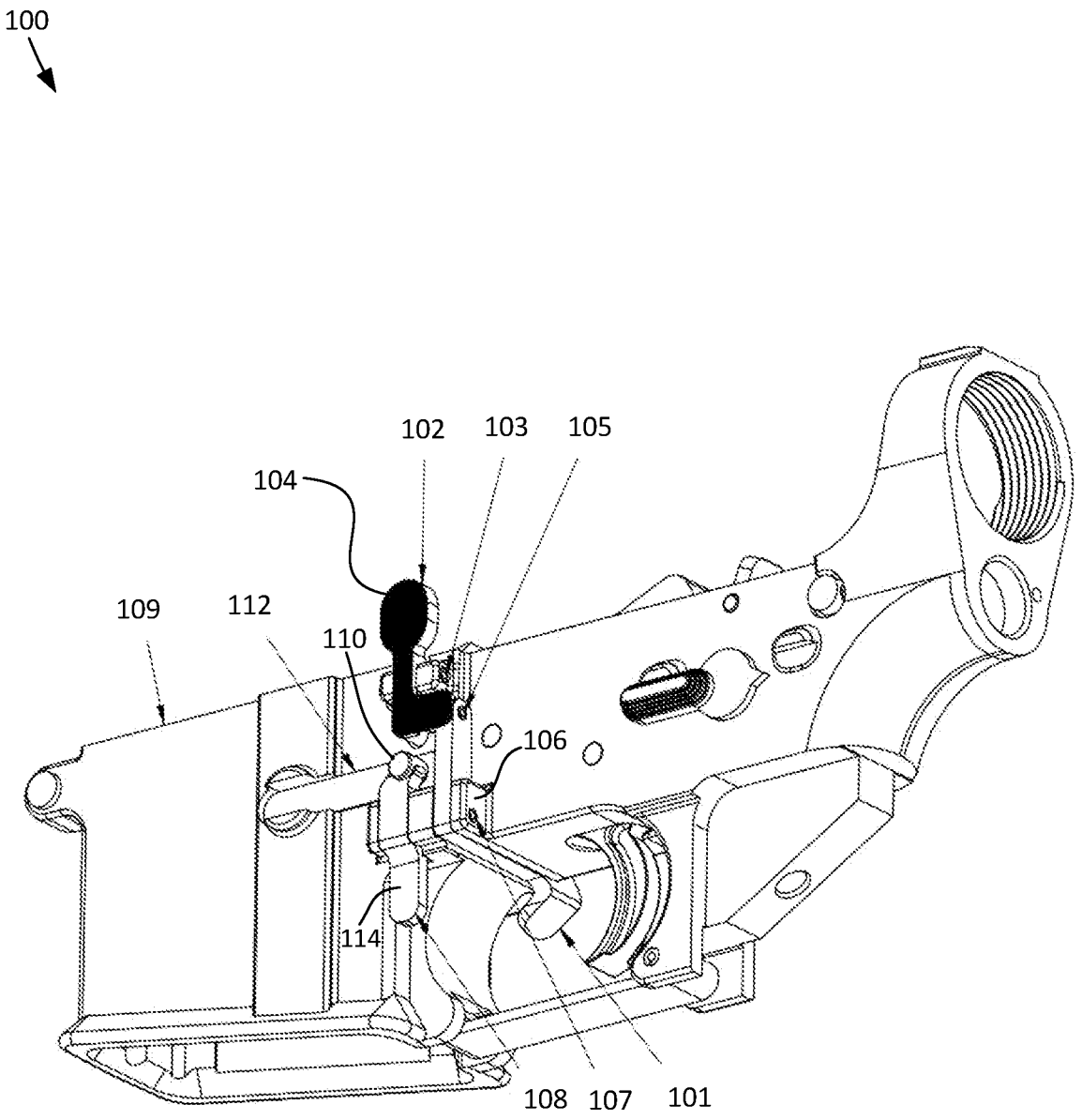
FIG. 1 is a perspective view diagram illustrating one example of a lower receiver 100 according to examples of the subject disclosure.

FIG. 1 is a perspective view diagram illustrating one example of a lower receiver 100 according to examples of the subject disclosure. The lower receiver 100 is a housing for internal action components (not shown here) such as the fire control group (e.g., trigger mechanism) for a firearm. The lower receiver 100 also provides mounting points for the upper receiver, buffer assembly, a magazine, and the stock (see FIG. 6). The lower receiver 100 may be used with the M16 family of firearms including, but not limited to, all AR variants, the M16 firearm, the M4 firearm, and others with use a bolt carrier. As used herein, the terms "forward" and "front" refer to ends of mechanisms that are nearest the muzzle end of a firearm. Similarly, "rear," "rearward," correspond to ends of mechanisms that are furthest from the muzzle end of the firearm.

In certain examples, the lower receiver 100 of the depicted example includes an ambidextrous bolt catch assembly. The ambidextrous bolt catch assembly includes an L-shaped lever 101 (hereinafter "L lever 101") that is coupled to a bolt catch lever 102. A roll pin 103 secures the bolt catch lever 102 to the lower receiver 100. Similarly, a second roll pin 105, or other pivoting fastener, couples the L lever 101 to the bolt catch lever 102. The L lever 101, beneficially, activates the bolt catch lever 102 without overloading a bolt catch spring (not shown). Unlike other ambidextrous bolt catch levers which couple to a top paddle 104 of the bolt catch lever 102 (and always have mass hanging therefrom, and apply an oversized force to the top paddle 104), the L lever 101 is secured and supported to the lower receiver 100 at a pivot point 107 of a protrusion 106 formed in the side of the lower receiver 100. Additionally, the present disclosure the L lever 101 is an "up down" operation that can be manipulated by the trigger finger of the operator. For left-handed operators, the right-side bolt catch lever can be activated by a right thumb when inserting a magazine, thereby eliminating the need for a second operation with the shooting hand trigger finger on the left side control, thus simplifying and speeding the mag change. On the left side, the magazine release positioning of the lever simplifies the control system, reduces the number of parts in the system and simplifies maintenance. By engaging the shaft of the magazine catch, the magazine catch lever prevents binding and the linear pull better compresses a spring disposed around the shaft.

In the depicted example, the L lever 101 is pivotally secured to the protrusion at a 90-degree bend of the L lever 101. Pivoting at the elbow of the L lever 101 beneficially unloads the bolt catch spring (not shown) because the weight of the L lever 101 is supported by a pin or other fastener in the protrusion 106. Additionally, the protrusion 106 functions as a guard to the L lever 101 and prevents inadvertent activation of the bolt catch lever 102.

In certain examples, the L lever 101 passes through an area defined by a trigger guard. A notch or recessed channel may be formed in the lower receiver 100 so that the L lever 101 sits flush within the area of the trigger.

In certain examples, the lower receiver 100 includes an ambidextrous magazine catch lever 108 for releasing a magazine inserted into a magazine well 109. The magazine catch lever 108 engages the magazine catch shaft 110 to apply a substantially linear, non-binding force on a magazine catch bar 112. Unlike other ambidextrous magazine catch levers, the magazine catch lever 108 of the subject disclosure applies a force to the magazine catch shaft 110 in substantially a same direction (i.e., outward laterally in a direction transverse and/or substantially perpendicular to, an axis defined by a bore of the firearm barrel) as a traditional magazine catch button (not shown) that is positioned on an opposite side of the lower receiver 100 from the magazine catch lever 108. Beneficially, this prevents binding, which common ambidextrous magazine catches are prone to do because they attach further down the magazine catch bar 112 which can cause the magazine catch bar 112 to bind due to a force being applied at a point that is offset from the magazine catch shaft 110. Additionally, the ambidextrous magazine catch lever 108 is simpler to manufacture and assemble because the magazine catch lever 108 may be separately formed. In certain examples, the paddle 114 of the magazine catch lever 108 is disposed in front of the trigger guard where it can be activated with the trigger (index) finger of a left-handed operator or the thumb of a right-handed operators support hand.

The ambidextrous controls, both L lever 101 and the magazine catch lever 108, are attached to the lower receiver 100 by one common attachment device 116 (e.g., a pin or screw) that passes through the protrusion 106 and both levers. This arrangement does not require any additional internal parts, springs, detents, shafts or mechanisms that are proprietary or non-standard AR platform parts. The firearm can operate normally without the ambidextrous controls attached. Manufacturing, assembly, disassembly and maintenance are greatly simplified with this design.

Figure 2:
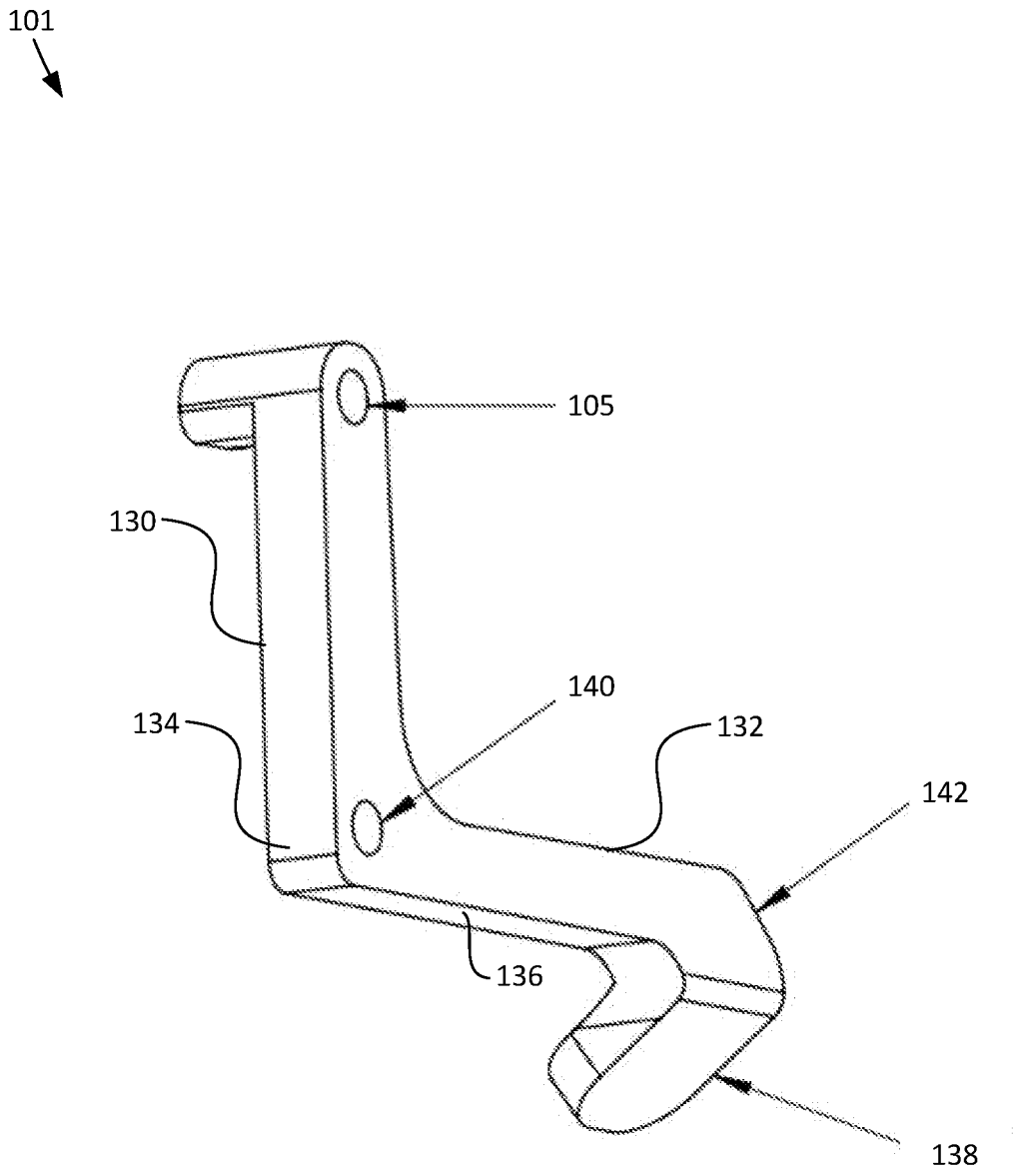
FIG. 2 is a perspective view diagram of the L lever, according to examples of the subject disclosure.

FIG. 2 is a perspective view diagram of the L lever 101, according to examples of the subject disclosure. The L lever 101, in certain examples, is formed of two arms, a vertical arm 130 and a horizontal arm 132. The vertical arm 130 extends downward from the bolt catch lever 102 to an approximately 90-degree elbow 134. The horizontal arm 132 is configured to extend through the area defined by the trigger guard to allow a user of the lower receiver 100 to activate the bolt catch lever 102 from the opposite side of the lower receiver 100. The lower receiver 100 may be formed with a slot sized to receive the L lever 101 such that a bottom surface 136 of the horizontal arm 132 forms a portion of the trigger area.

Coupled to the horizontal arm 132, opposite the vertical arm 130, is a finger paddle 138 that, in certain examples, extends downward from the horizontal arm 132. The finger paddle 138 allows an operator of the lower receiver 100 to use a downward motion on the right side of the lower receiver to activate the bolt catch lever 102 on the left side of the lower receiver 100. When the bolt carrier locks back because of an empty magazine, the finger paddle 138 moves downward as the bolt catch engages and rotates outward. This action causes the L lever 101 to pivot on the elbow 134 pivot pin 107 in opening 140 and move the bottom pad 302 (see FIG. 3) of the bolt catch lever 102. With the top paddle 104 in the downward position, an operator is then able to release and eject the empty magazine and insert a loaded magazine. The operator then uses their trigger finger to press upward on the top paddle 104 with their right-hand trigger (index) finger which reverses the prior movements and releases the bolt carrier.

To lock the bolt carrier back using the right-side 142 of the L lever 101, the operator would move the bolt carrier to the rear using the charging handle and then use the trigger (index) finger to press down on the top paddle 104. This action pivots the bolt catch lever 102 outward raising up the stop portion 304 of the bolt catch lever 102 (see FIG. 3) which then engages the bolt face in the bolt carrier group (not shown).

Figure 3:
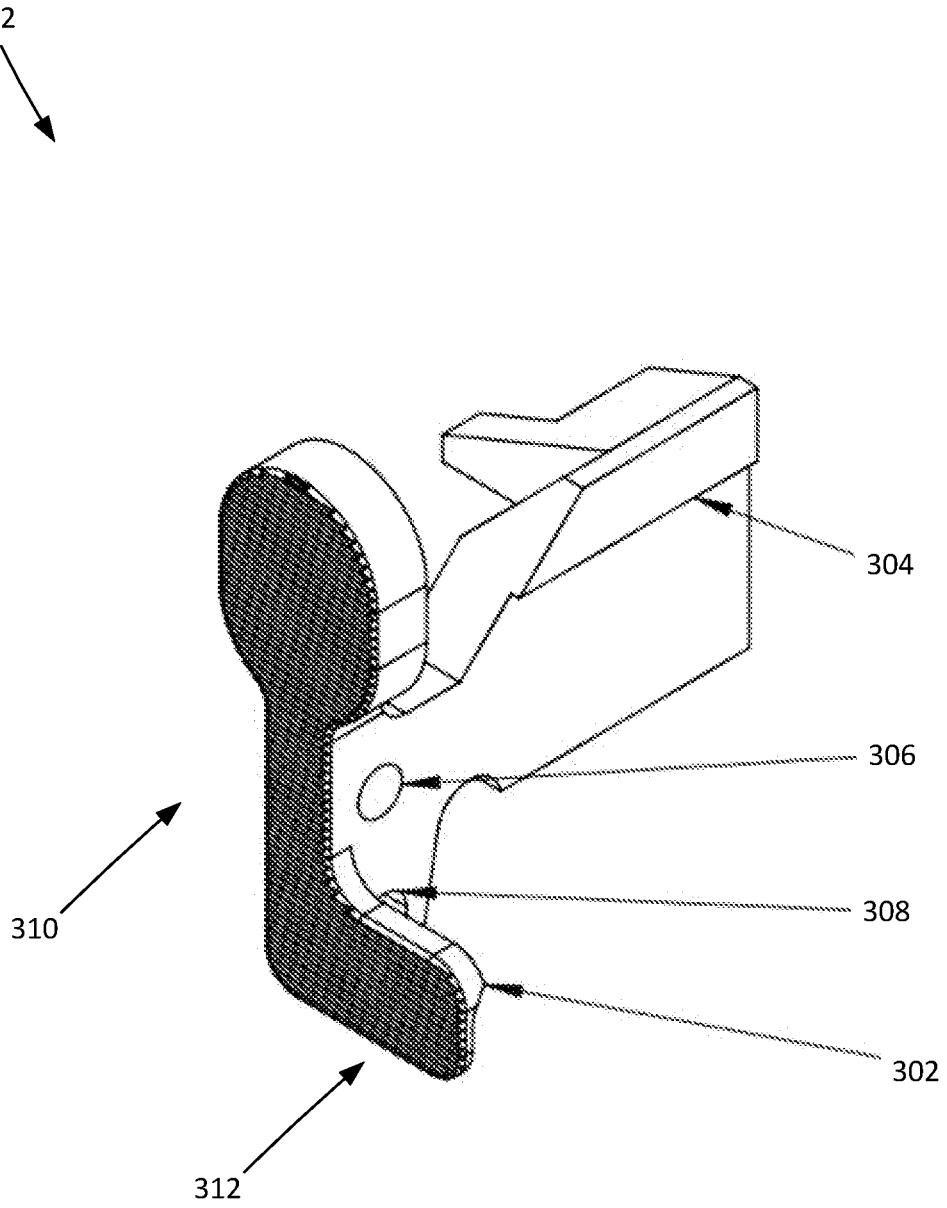
FIG. 3 is a perspective view diagram of the bolt catch lever, according to examples of the subject disclosure.

FIG. 3 is a perspective view diagram of the bolt catch lever 102, according to examples of the subject disclosure. In the depicted embodiment, the bolt catch lever 102 is formed with the bottom pad 302, a stop portion 304, an opening for receiving a pivot pin 306 and an opening for receiving a pivot coupler 308. The bolt catch lever 102 functions in a manner similar to common bolt catch levers 102, however, the bolt catch lever 102 of the subject disclosure is configured to pivotally couple with the L lever 101 via a fastener such as a roll pin for example. In certain examples, the bolt catch lever 102 is formed with a textured finger pad 310. The textured finger pad 310 may be oriented, generally, in a vertical direction, with a region 312 that extends outward in a rearward direction (with reference to the firearm towards a stock) from the vertically extending finger pad 310. The region 312 beneficially allows for the L lever 101 to couple with the bolt catch lever 102.

Figure 4:
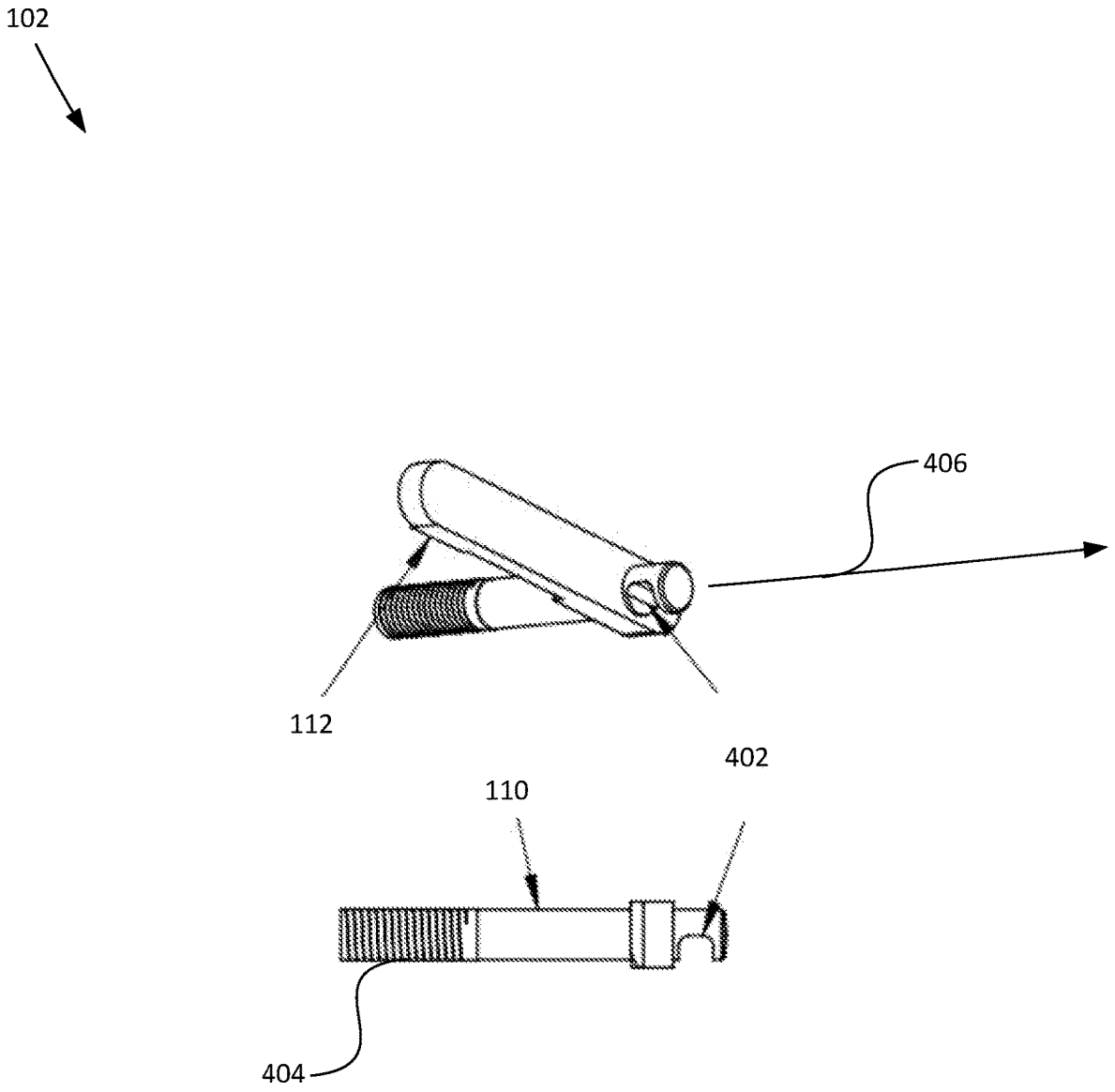
FIG. 4 illustrates different views of the magazine catch shaft and the magazine catch bar, according to examples of the subject disclosure.

FIG. 4 illustrates different views of the magazine catch shaft 110 and the magazine catch bar 112, according to examples of the subject disclosure. As known to those skilled in the art, common magazine catch shafts 110 are configured to couple a magazine catch button, which is disposed on a right side of a lower receiver, with the magazine catch bar 112, which is disposed on a left side of the lower receiver. The magazine catch shaft 110 couples these components by extending through an interior of the lower receiver 100 in front of the trigger area. The magazine catch bar 112 secures a magazine in the magazine well unless moved by the magazine catch shaft 110.

In certain examples the magazine catch shaft 110 is provided with a coupling mechanism 402 for engaging an end of the magazine catch lever 108. The coupling mechanism 402 is disposed adjacent a first end of the magazine catch shaft 110. In certain examples, the coupling mechanism 402 is disposed opposite threads 404 that are disposed adjacent a second end of the magazine catch shaft 110. The threads 404 are useful for coupling the magazine catch shaft 110 with the magazine catch button (not shown). The coupling mechanism 402, in certain examples, is formed as a hook that engages an end of the magazine catch lever 108 (see FIG. 5). This beneficially allows for the angular movement of the magazine catch lever 108 to translate into linear movement of the magazine catch shaft 110. In other words, a depression of a finger pad of the magazine catch lever 108 translates through a pivot point and causes the opposite side to move in an arcuate path, in a manner similar to any lever and fulcrum.

Figure 5:
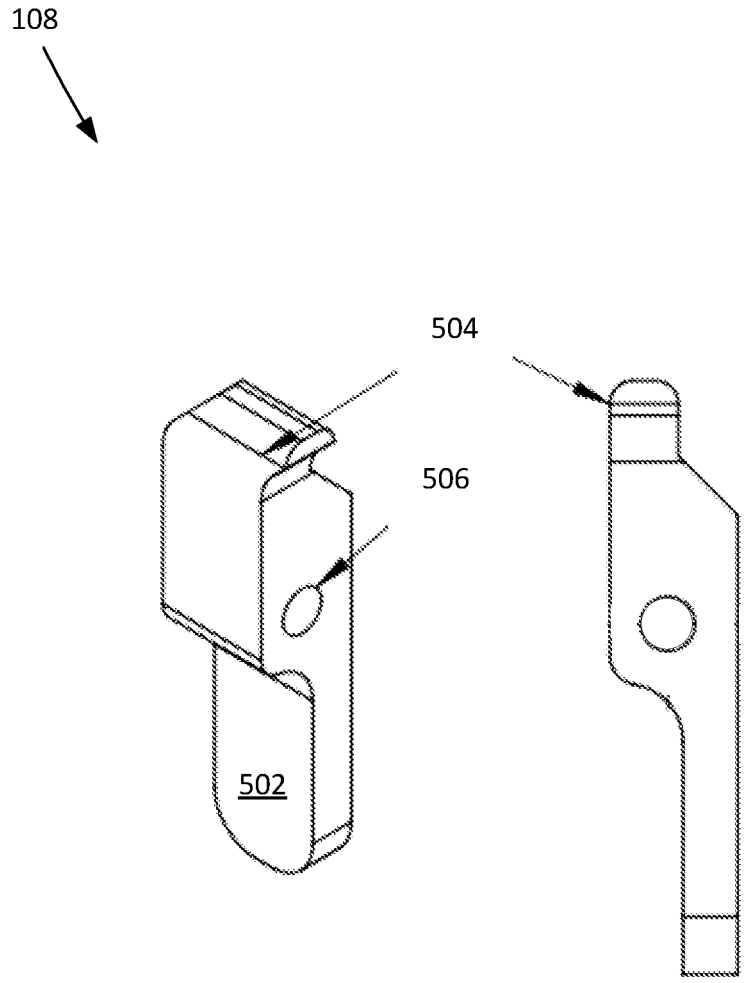
FIG. 5 is a diagram illustrating different views of the magazine catch lever, according to examples of the subject disclosure.

FIG. 5 is a diagram illustrating different views of the magazine catch lever 108, according to examples of the subject disclosure. Depicted are perspective and side views of the magazine catch lever 108. In certain examples, the magazine catch lever 108 is an elongated body having first and second ends. Positioned adjacent the first end is a finger pad 502. Positioned adjacent the second end, in certain examples, is a catch bar engagement member 504. The catch bar engagement member 504 is configured to insert into the coupling mechanism 402 of the magazine catch shaft 110. In certain examples, the catch bar engagement member 504 has a rounded exterior surface that is configured and shaped to engage the coupling mechanism 402.

In certain examples, the magazine catch lever 108 is formed with an opening 506 for receiving roll pin or other fastener in the pivot point 107 described above. The magazine catch lever 108, in certain examples, is configured with a width selected to allow the magazine catch lever 108 to fit into a notch or slot formed in the protrusion 106.

In one example of operation, the ambidextrous magazine catch lever 108 is pressed by the operator and pivots about the pivot point 107. The catch bar engagement member 504 engages a slot or hook in the magazine catch shaft 110 which pulls the magazine catch shaft 110 outward to the left side of the lower receiver 100. The magazine catch bar 112, which is coupled with the magazine catch shaft 110, is also pulled outward in a "left direction" as indicated by arrow 406 of FIG. 4, which allows the magazine to release or be removed. A standard AR magazine catch/release spring may be used which is inserted form a right side of the lower receiver 100 over the magazine catch shaft 110 and a magazine release button (not shown) is screwed on the magazine catch shaft 110 to retain the spring and provide a surface to which force can be applied to activate the magazine release on the right side of the lower receiver 100.

Figure 6:
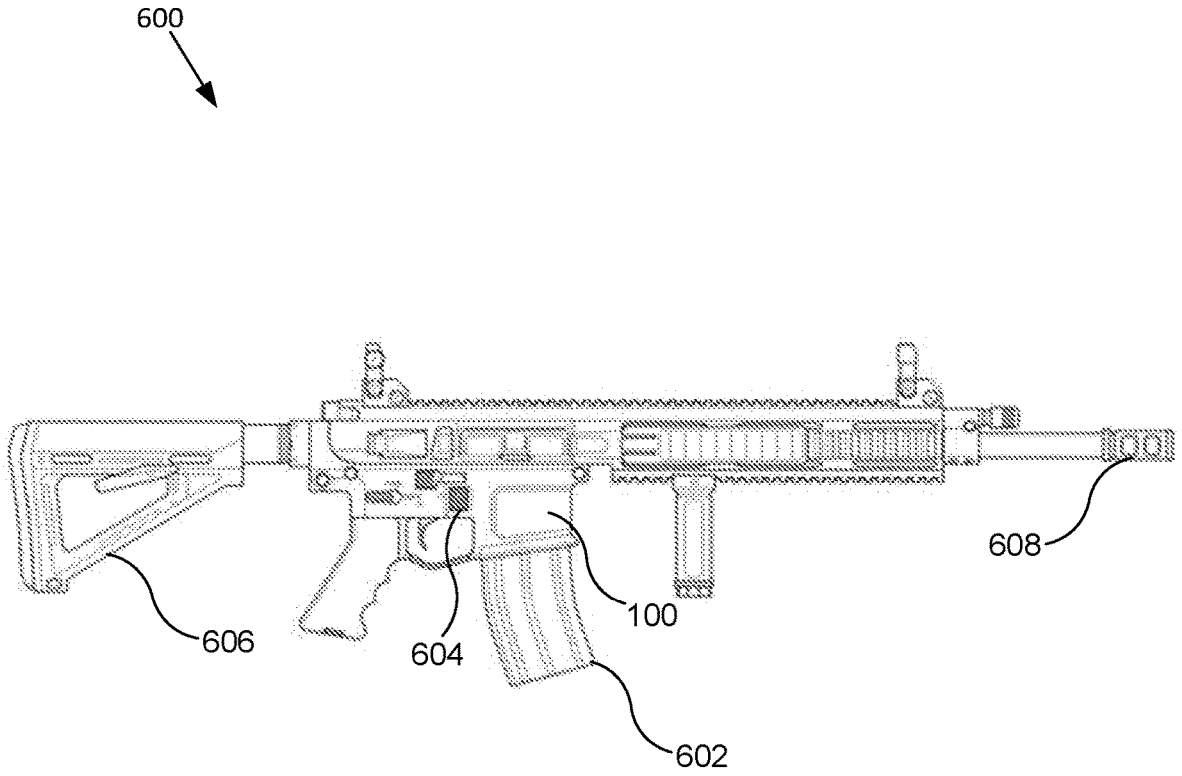
FIG. 6 is a side view diagram illustrating one example of a right side of a firearm including an improved lower receiver in accordance with examples of the present disclosure.

FIG. 6 is a side view diagram illustrating one example of a right side of a firearm 600 including an improved lower receiver 100 in accordance with examples of the present disclosure. As described above, the lower receiver 100 is configured with a protrusion for pivotally engaging the L lever and the magazine catch assembly. Also depicted are a magazine 602 inserted into the lower receiver 100, a magazine release button 604, a stock 606, and a muzzle 608 disposed at an end of a barrel. The barrel defines a bore axis that extends lengthwise along the firearm 600.

Figure 7A:
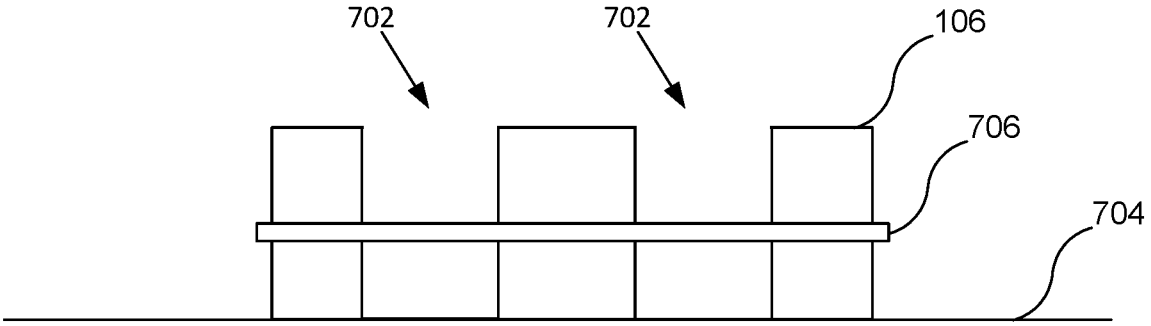
FIG. 7*a* is a schematic block diagram of a cross-section view of the protrusion, according to examples of the subject disclosure.

FIG. 7*a* is a schematic block diagram of a cross-section view of the protrusion 106, according to examples of the subject disclosure. The diagram illustrates a top or bottom view of the protrusion 106. The protrusion 106, as described above, may be integrally formed with the lower receiver. The protrusion 106, in certain examples, is formed with one or more slots 702 for receiving either or both of the bolt catch lever 102 or the magazine catch lever 108. The protrusion 106 extends outward from an exterior surface 704 of the lower receiver 100. In certain examples, the protrusion extends outward from the left side of the lower receiver 100. An opening in the protrusion 106 is configured to receive a pin 706 or other fastener to secure the levers to the protrusion 106 and allow pivoting of the levers. An axis defined by the opening (and subsequently the fastener) is transverse to an axis defined by the levers which generally extend vertically and the fastener extends horizontally.

Figure 7B:
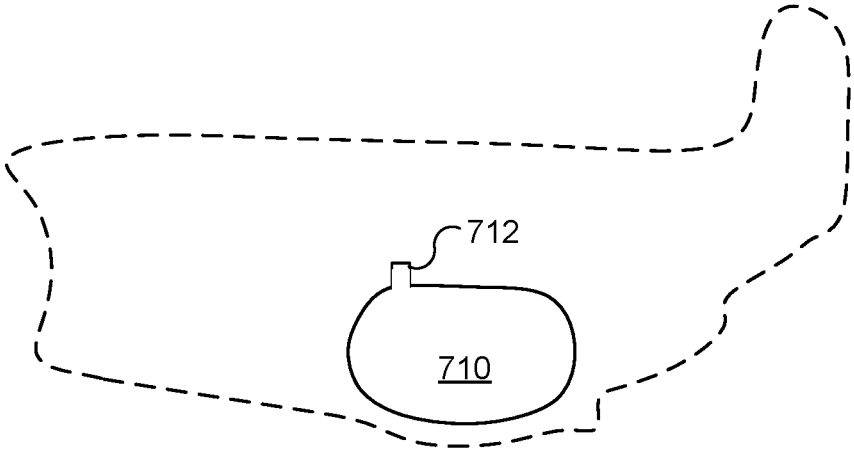
FIG. 7*b* is a block diagram illustrating a trigger area of a lower receiver, according to examples of the subject disclosure.

FIG. 7*b* is a block diagram illustrating a trigger area of a lower receiver 100, according to examples of the subject disclosure. As described above, the trigger area 710 includes a slot 712 or notch for receiving the L lever 101. In certain examples, the slot 712 extends laterally (i.e., from side to side) from the left side of the lower receiver to the right side of the lower receiver. The slot 712 beneficially allows for the L lever 101 to extend from the right side of the lower receiver 100 to the left side without interfering with the operation of the trigger.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A lower receiver of a firearm comprising:

a protrusion extending outward from a first side of the lower receiver, the protrusion comprising:

a first slot for receiving an L-shaped lever, the L-shaped lever having a vertical arm coupled to a bolt catch lever and a horizontal arm that extends through a trigger area to a second side of the lower receiver that is opposite the first side; and a second slot for receiving a magazine catch lever.

2. The lower receiver of claim 1, where the protrusion further comprising an opening for receiving a fastener that passes through at least one of the L-shaped lever or the magazine catch lever.

3. The lower receiver of claim 2, where the fastener passes through both of the L-shaped lever and the magazine catch lever.

4. The lower receiver of claim 1, further comprising a slot formed in the trigger area configured to receive the L-shaped lever.

5. The lower receiver of claim 4, where the slot extends laterally from the first side to the second side.

6. The lower receiver of claim 1, where the vertical arm is pivotally coupled to the bolt catch lever.

7. The lower receiver of claim 6, where the bolt catch lever further comprises a rearwardly extending region configured to engage an end of the L-shaped lever.

8. The lower receiver of claim 1, where the magazine catch lever is an elongated member having a first end for engaging a magazine catch shaft and a second end forming a finger pad.

9. The lower receiver of claim 8, where the magazine catch shaft extends from a first end to a second end, where threads are disposed adjacent the first end, and where a coupling mechanism is disposed adjacent the second end and configured to engage the first end of the magazine catch lever.

10. The lower receiver of claim 9, further comprising a magazine release button configured to couple to the first end of the magazine catch shaft.

11. The lower receiver of claim 9, further comprising a magazine catch bar coupled at the second end of the magazine catch shaft, and configured to secure a magazine in a magazine well of the lower receiver.

12. A lower receiver of a firearm comprising:

a protrusion extending outward from a first side of the lower receiver, the protrusion comprising:

a slot for receiving an L-shaped lever, the L-shaped lever having a vertical arm coupled to a bolt catch lever and a horizontal arm that extends through a trigger area to a second side of the lower receiver that is opposite the first side.

13. The lower receiver of claim 12, where the protrusion further comprising an opening for receiving a fastener that passes through L-shaped lever.

14. The lower receiver of claim 12, further comprising a slot formed in the trigger area configured to receive the L-shaped lever.

15. The lower receiver of claim 14, where the slot extends laterally from the first side to the second side.

16. The lower receiver of claim 12, where the vertical arm is pivotally coupled to the bolt catch lever.

17. The lower receiver of claim 16, where the bolt catch lever further comprises a rearwardly extending region configured to engage an end of the L-shaped lever.

18. A lower receiver of a firearm comprising:

a protrusion extending outward from a left side of the lower receiver, the protrusion comprising a slot for receiving a magazine catch lever, where the slot is oriented transverse to a firing direction, where the magazine catch lever is an elongated member having a first end for engaging a magazine catch shaft and a second end forming a finger pad, and where the magazine catch shaft extends from a first end to a second end; and a magazine catch bar coupled at the second end of the magazine catch shaft, and configured to secure a magazine in a magazine well of the lower receiver.

19. The lower receiver of claim 18, where the magazine catch shaft further comprises threads disposed adjacent the first end, and where a coupling mechanism is disposed adjacent the second end and configured to engage the first end of the magazine catch lever.

* * * * *